US006170964B1

(12) United States Patent
Hsu

(10) Patent No.: US 6,170,964 B1
(45) Date of Patent: Jan. 9, 2001

(54) ORNAMENTAL LIGHTING DEVICE WITH A FLEXIBLY- SHAPABLE LIGHT EMITTING TUBE CAPABLE OF PORTRAYING USER-DESIGNED SIGNS IN A FLICKERING MANNER

(76) Inventor: Owen Hsu, 5F, No. 524, Chun Young Rd., nan-Gaang, Taipei (TW)

( * ) Notice: Under 35 U.S.C. 154(b), the term of this patent shall be extended for 0 days.

(21) Appl. No.: 09/152,900

(22) Filed: Sep. 14, 1998

(30) Foreign Application Priority Data

Jun. 16, 1998 (TW) ..... 87209559

(51) Int. Cl.[7] ..... F21V 23/04
(52) U.S. Cl. ..... 362/251; 362/227; 315/198
(58) Field of Search ..... 362/236, 240, 362/249, 251, 252, 219, 278, 320, 184, 227; 315/195, 198

(56) References Cited

U.S. PATENT DOCUMENTS 4,107,767 * 8/1978 Anquetin ..... 362/236
4,263,640 * 4/1981 Altman ..... 362/252
4,950,958 * 8/1990 Lin ..... 315/185 R
5,027,037 * 6/1991 Wei ..... 315/185 S
5,150,964 * 9/1992 Tsui ..... 362/251
5,379,202 * 1/1995 Daun ..... 362/251
5,410,458 * 4/1995 Bell ..... 362/219
5,559,681 * 9/1996 Duarte ..... 362/252
5,688,041 * 11/1997 Arndt ..... 362/219

* cited by examiner

*Primary Examiner*—Alan Cariaso
(74) *Attorney, Agent, or Firm*—Ezra Sutton

(57) ABSTRACT

An ornamental lighting device is provided with a flexibly-shapable light-flickering tube that can be bent into user-designed signs, such as marks, graphics, letters, and many various others, and displayed in a flickering manner. The ornamental lighting device includes an elongated transparent tube having a hollowed inside; a cable of insulated conductive wires including one common wire and a plurality of triggering wires; a plurality of bands of serially-connected lamps mounted in the hollowed inside of the elongated transparent tube, each band of lamps having one end electrically connected to the common wire and the other end connected to one of the triggering wires; and a controller connected to the cable, which is capable of applying a voltage alternately in a predetermined sequence to the triggering wires so as to light up the associated lamps in the lamp bands in the predetermined sequence.

7 Claims, 7 Drawing Sheets

ORNAMENTAL LIGHTING DEVICE WITH A FLEXIBLY- SHAPABLE LIGHT EMITTING TUBE CAPABLE OF PORTRAYING USER-DESIGNED SIGNS IN A FLICKERING MANNER

BACKGROUND OF THE INVENTION

1. Field of the Invention

This invention relates to a lighting device, and more particularly, to an ornamental lighting device with a flexibly-shapable light emitting tube that can be bent into user-designed signs, such as marks, graphics, letters, and many various others, and portray these signs in a flickering manner.

2. Description of Related Art

FIG. 1 is a schematic perspective diagram of a conventional ornamental lighting device with a part cut away to show the inside structure. As shown, this conventional ornamental lighting device includes an elongated transparent tube which is made from PVC that allows it to be bent into any shape. The elongated transparent tube is formed with two longitudinally-extending grooves 2 for mounting two respective bands of serially-connected lamps 3 therein. These lamps 3 are connected to electrical contacts 1 mounted on the external side of the elongated transparent tube. The elongated transparent tube is wrapped in PVC insulation 4 which is typically colored to allow the lights emitted from the lamps 3 to display certain colors that are prescribed by the art designer. A controller (not shown) is connected via the electrical contacts 1 to these lamps 3, which can control the on/off states of the lamps 3 in any predetermined sequences.

One drawback to the foregoing ornamental lighting device, however, is that the number of lamps mountable in the grooves 2 is limited. The number of patterns that can express chasing light produced by the ornamental lighting device is therefore limited. Moreover, since the mounting of the two bands of lamps 3 in the elongated transparent tube requires the forming of two grooves 2 in the elongated transparent tube, the overall size of the ornamental lighting device is considerably bulky, making the ornamental lighting device less compact in size. If it is desired to increase the number of flickering patterns that can express chasing light produced by the ornamental lighting device, the wires interconnecting the lamps 3 the grooves 2 for mounting the lamps 3 should be both increased in number, which will make the overall size of the ornamental lighting device even more bulky and require more even components to assemble. The manufacture of the ornamental lighting device is also difficult to carry out and also high in cost. Moreover, since the lamps 3 of the ornamental lighting device of FIG. 1 are necessarily arranged on opposite sides of the elongated transparent tube, the lights emitted therefrom are scattered rather than concentrated, resulting in an uneven flickering effect.

Another conventional ornamental lighting device is shown in FIGS. 2 through 4. As shown in FIGS. 2 and 3, this ornamental lighting device also includes an elongated transparent tube 5 wrapped in PVC insulation 4. The elongated transparent tube 5 has a hollowed inside in which a single band of serially-connected lamps 3 is mounted. The lamps 3 are interconnected by insulated copper wires 7 and connected to a plurality of electrical contacts 1, 1*a*, 1*b*, 1*c* provided on the outside of the elongated transparent tube 5, of which the electrical contact 1 is connected to a common wire. Moreover, as shown in FIG. 2, the PVC insulation 4 is formed with a V-shaped opening 6. In assembly, this V-shaped opening 6 allows the lamps 3 to be mounted in the hollowed inside of the elongated transparent tube 5 by inserting them through this V-shaped opening 6.

One drawback to the foregoing ornamental lighting device, however, is that the interconnecting wires 7 for the lamps 3 in the elongated transparent tube 5 should not be too large in number; otherwise, they can obstruct the light emitted from the lamps 3 or cause short-circuits with each other. Therefore, as shown in FIG. 4, the lamps 3 can only be interconnected in a fixed manner, and cannot be arranged arbitrarily by the art designer for more creative patterns.

SUMMARY OF THE INVENTION

It is therefore an objective of the present invention to provide a new ornamental lighting device, which can light up its lamps in bands sequentially and alternatively in accordance with the order of portraying a mark, graph, letter and many various others.

It is another objective of the present invention to provide a new ornamental lighting device, which is easier to manufacture and more reliable to use as compared to the prior art.

It is still another objective of the present invention to provide a new ornamental lighting device, which can emit lights uniformly from the center of the elongated transparent tube.

In accordance with the foregoing and other objectives of the present invention, a new ornamental lighting device is provided.

The ornamental lighting device of the invention includes the following constituent parts:

(a) an elongated transparent tube having a hollowed inside;

(b) a cable of insulated conductive wires including one common wire and a plurality of triggering wires;

(c) a plurality of bands of serially-connected lamps mounted in the hollowed inside of the elongated transparent tube, each band of lamps having one end electrically connected to the common wire and the other end connected to one of the triggering wires; wherein the arrangement of the bands of serially-connected lamps in the hollowed inside of the elongated transparent tube is arranged in a staggered manner such that a first band of serially-connected lamps is followed by a second band of serially-connected lamps, the second band of serially connected lamps is followed by a third band of serially-connected lamps and so on and (d) a controller connected to the cable, which is capable of applying a voltage alternately in a predetermined sequence to the triggering wires so as to light up the associated lamps in the predetermined sequence.

The foregoing ornamental lighting device can light up its lamps each band of alternatively in any predetermined sequences as controlled by the controller. Moreover, the ornamental lighting device of the invention is easier to manufacture and more reliable to use as compared to the prior art, and can radiate lights uniformly from the center of the elongated transparent tube. The invention is therefore more advantageous in manufacture and utilization than the prior art.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
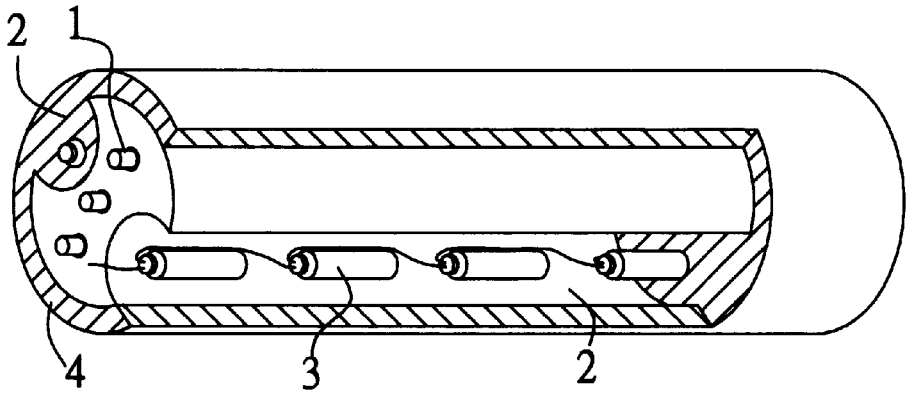
FIG. 1 (PRIOR ART)
FIG. 1 is a schematic perspective diagram of a first conventional ornamental lighting device.
Figure 2:
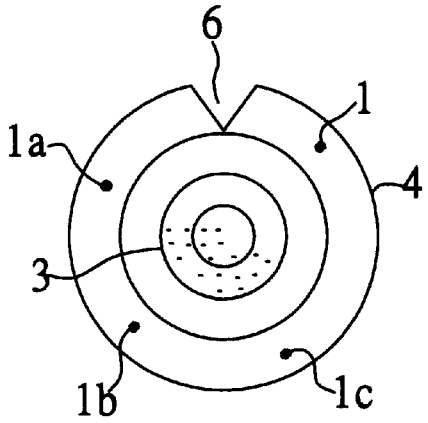
FIG. 2 (PRIOR ART)
FIG. 2 is a schematic sectional diagram of a second conventional ornamental lighting device.
Figure 3:
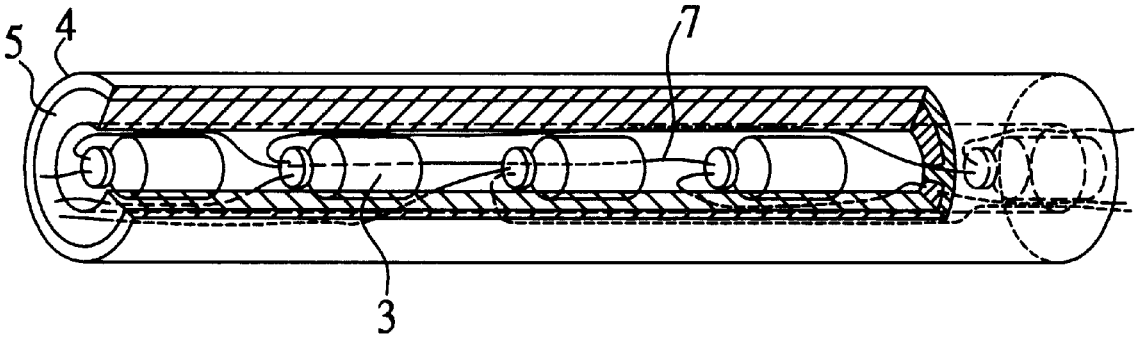
FIG. 3 (PRIOR ART)
FIG. 3 is a schematic perspective diagram of the second conventional ornamental lighting device of FIG. 2.
Figure 4:
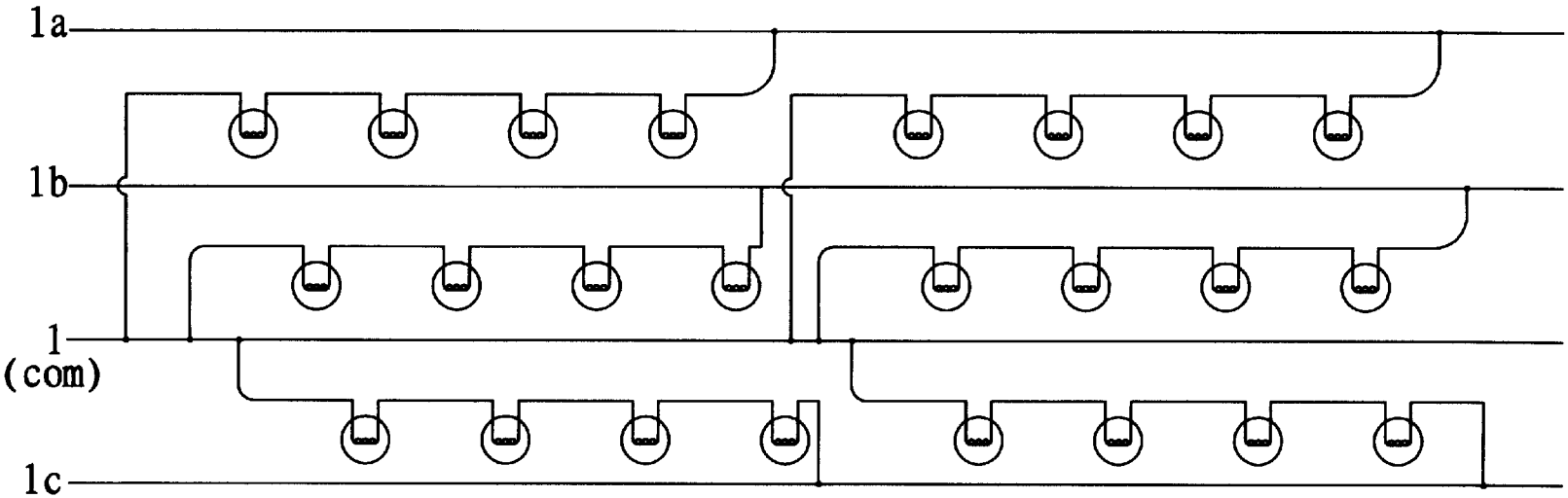
FIG. 4(PRIOR ART)
FIG. 4 is a schematic diagram showing the circuit scheme of the second conventional ornamental lighting device of FIGS. 2 and 3.
Figure 5:
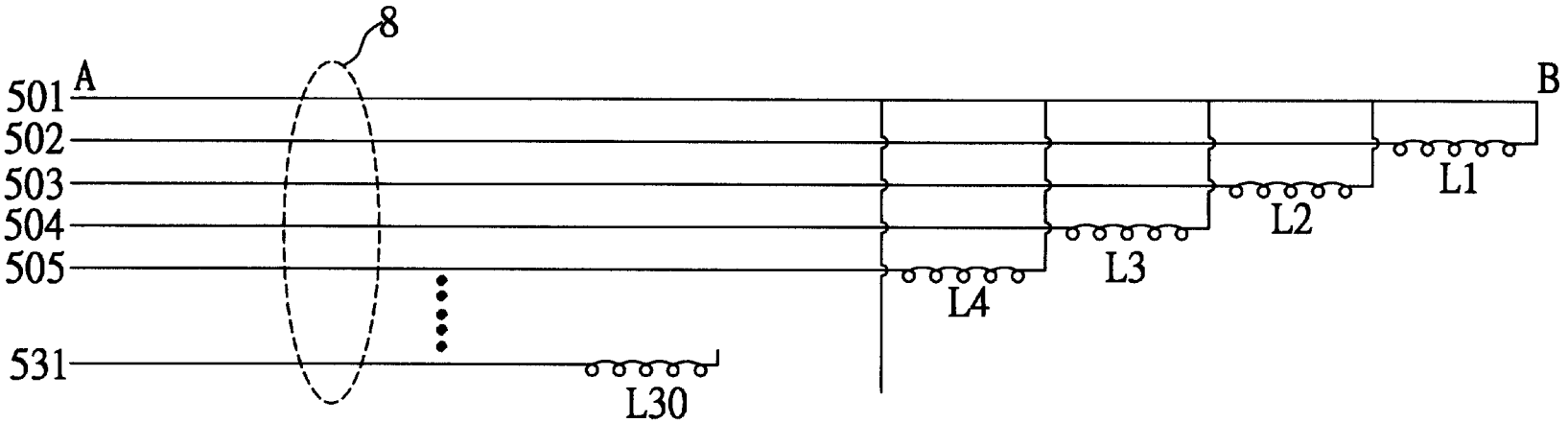
FIG. 5 is a schematic diagram showing the circuit scheme of the ornamental lighting device according to the invention.

FIG. 5 is a schematic diagram showing the circuit scheme of the ornamental lighting device according to the invention. As shown, the ornamental lighting device includes a plurality of, for example 31, bands of lamps L1, L2, . . . , L31, each band including a fixed number of lamps. These lamp bands L1, L2, . . . , L31 are wired to a cable 8 having a corresponding number of insulated conductive wires including a common wire 501 and a plurality of triggering wires 502, 503, . . . , 531. Each band of lamps L1, L2 . . . L3 has one end electrically connected to the common wire 501 and the other end connected to the triggering wires 502, 503 . . . 531 respectively, wherein the arrangement of the bands is serially-connected lamps L1, L2 . . . L3 in the hollowed inside of an elongated transparent tube 5 (see FIG. 6) is in a manner the lamp band 1 is followed by lamp band 2, the lamp band 2 is followed by lamp band 3, and so on. The cable 8 has a first end A (an open end) for connecting to a controller (not shown here, see FIGS. 8 and 11) and a second end B (a closed end).

The controller (not shown here, see FIGS. 8 and 11) can apply a voltage alternately in a predetermined sequence to the triggering wires 502, 503, . . . , 531, so as to light up the associated lamps in the lamp bands L1, L2, . . . , L31. The predetermined sequence can be L1→L2→ . . . →L30→L31; or L31→L30→ . . . L2→L1; or any other possible sequence, which can be arbitrarily prescribed by the art designer.

Figure 6:
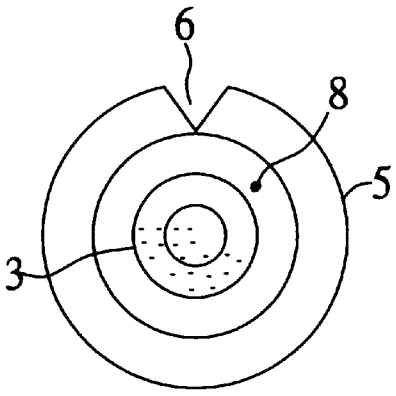
FIG. 6 is a schematic sectional diagram of a first preferred embodiment of the light flickering part of the ornamental lighting device of the invention.

FIG. 6 is a schematic sectional diagram of a first preferred embodiment of the light flickering part of the ornamental lighting device of the invention. As shown, the cable 8 and the lamps 3 are wrapped in an elongated transparent tube 5. All the wires in the cable 8 are insulated copper wires. The elongated transparent tube 5 is formed with a V-shaped opening 6 to allow the cable 8 and the lamps 3 to be inserted therethrough so as to be mounted in the hollowed inside of the elongated transparent tube 5. Moreover, the elongated transparent tube 5 is flexible so that it can be bent into any user-designed shapes, such as marks, graphics, letters, and many others. In addition, a PVC insulation layer (not shown) can be used to wrap around the elongated transparent tube 5, which can be colored in any color and shaped into any shape in cross section, such as circular, triangular, square, hexagonal, or various other shapes.

Figure 7:
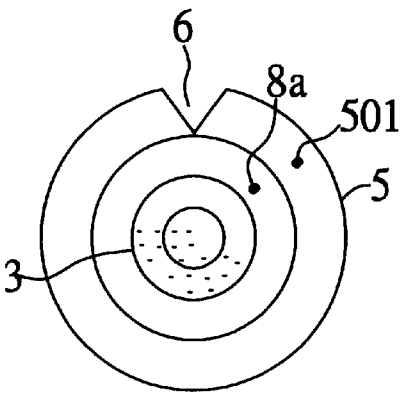
FIG. 7 is a schematic sectional diagram of a second preferred embodiment of the light flickering part of the ornamental lighting device of the invention.

Alternatively, as shown in FIG. 7, the ornamental lighting device can be designed in such a manner as to embed the common wire 501 in the surface layer of the elongated transparent tube 5, and bundle all the triggering wires 502, 503, . . . , 531 into a single strand 8*a*. This design scheme can help prevent the lamp bands from sliding within the hollowed inside of the elongated transparent tube 5.

It can be learned from the foregoing description that the ornamental lighting device of the invention is easier to manufacture and more reliable to use as compared to the prior art thanks to the fact that the insulated conductive wires 501, 502, . . . 531 and the lamp bands L1, L2, . . . , L31 can be assembled separately and then mounted altogether through the V-shaped opening 6 into the hollowed inside of the elongated transparent tube 5.

Moreover, since the lamp bands L1, L2 . . . , L31 can be bundled into a straight line to be centered in the elongated transparent tube 5, the lights emitted therefrom would be relatively unobstructed by embedded wires as they were in the elongated transparent tube 5 in the prior art. As a result the ornamental lighting device of the invention can provide a more uniform and unobstructed flickering light effect to the viewer.

Figure 8:
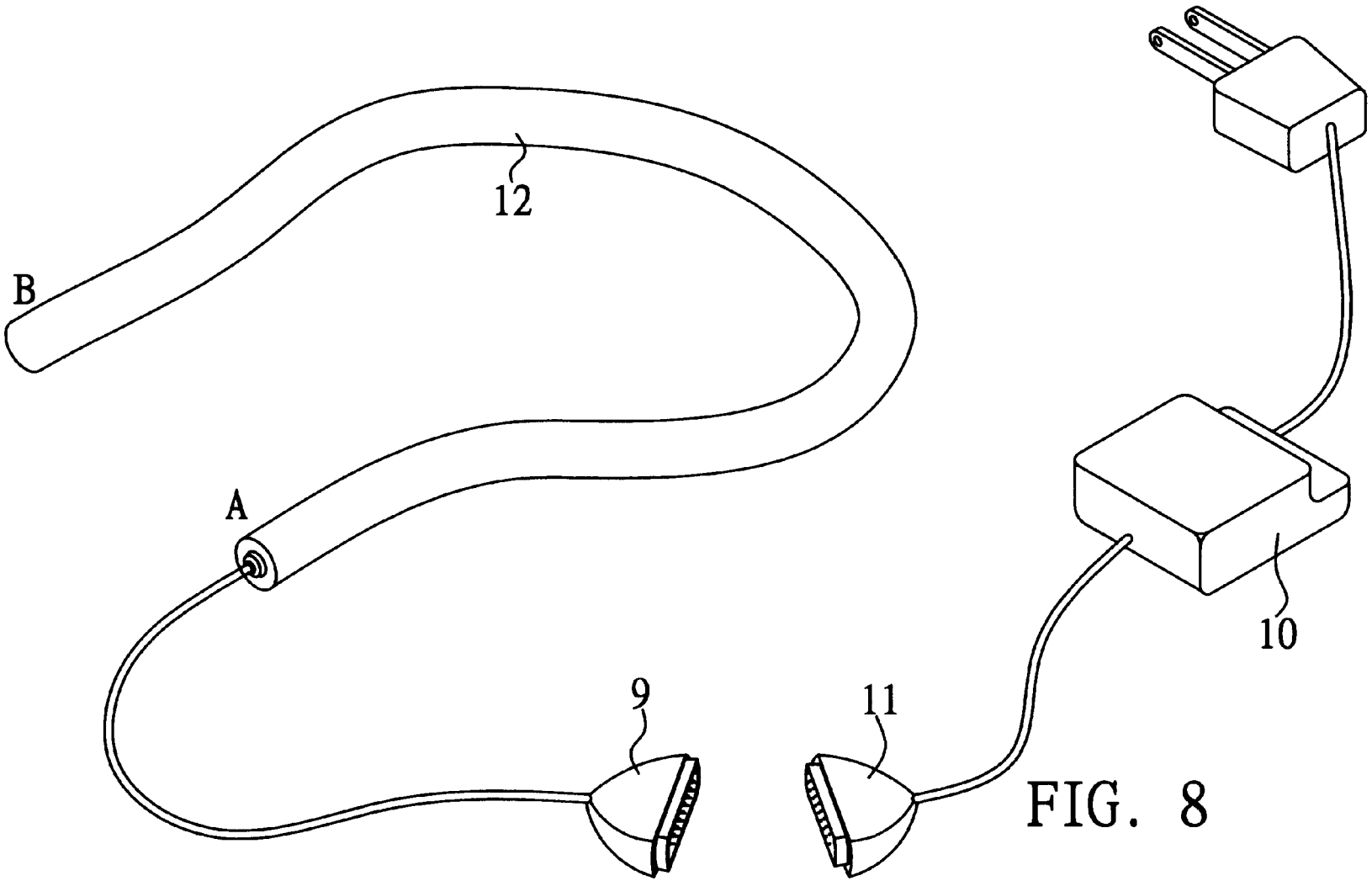
FIG. 8 is a schematic diagram showing the outer appearance of the product of the ornamental lighting device of the invention.

FIG. 8 is a schematic diagram showing the outer appearance of the product of the ornamental lighting device of the invention. As shown, the light emitting tube 12 of the ornamental lighting device of the invention has a first end A and a second end B. The first end A is connected to a first-type connector, such as a positive connector 9, which can be connected to a second-type connector, such as a negative connector 11, which is connected to a controller 10. The controller 10 is set in advance to apply a voltage alternately in a predetermined sequence to the triggering wires 502, 503, . . . , 531 connected to the lamp bands L1, L2, . . . , L31 in the light emitting tube 12 of the ornamental lighting device, causing the lamp bands L1, L2, . . . , L31 to flicker in the predetermined sequence.

Figure 9:
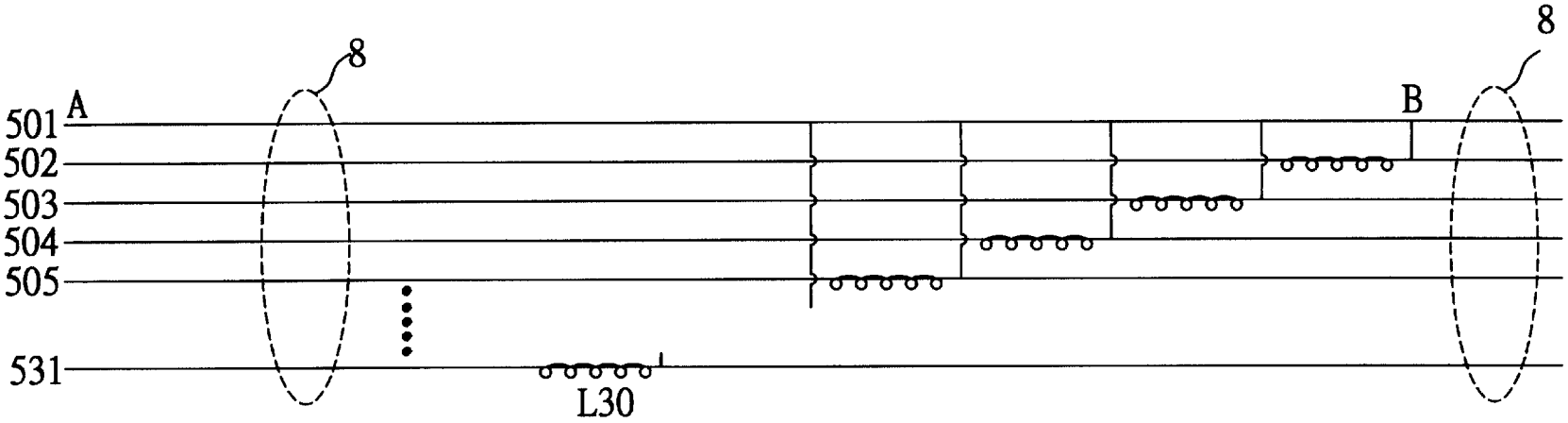
FIG. 9 is a schematic diagram showing the circuit scheme of two units of connecting light emitting tubes to double the length of the light emitting part of the ornamental lighting device.
Figure 10:
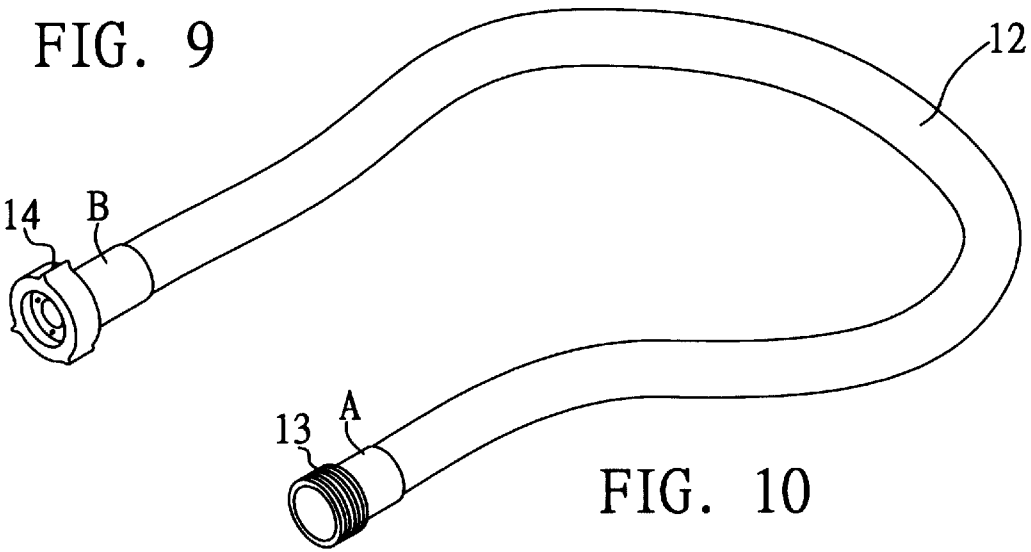
FIG. 10 is a schematic perspective diagram of the light emitting tube of the ornamental lighting device of the invention.

As shown in FIG. 9, in case the light emitting tube 12 of the ornamental lighting device is not long enough for the design of a certain mark, the second end B can be extended for connection to an additional unit of light emitting tube so that the overall length of the light emitting part of the ornamental lighting device can be doubled. As shown in FIG. 10, in order to implement this scheme, the first end A of the light emitting tube 12 is further connected to a positive coupler 13, and the second end B of the same is connected to a negative coupler 14. The positive coupler 13 has a total set of 31 pins (not shown) connected respectively to the 31 insulated conductive wires 501, 502, . . . 531; while the negative coupler 14 has a total set of 31 receptacle holes (not shown) for connection to the positive coupler of another unit of light emitting tube.

Figure 11:
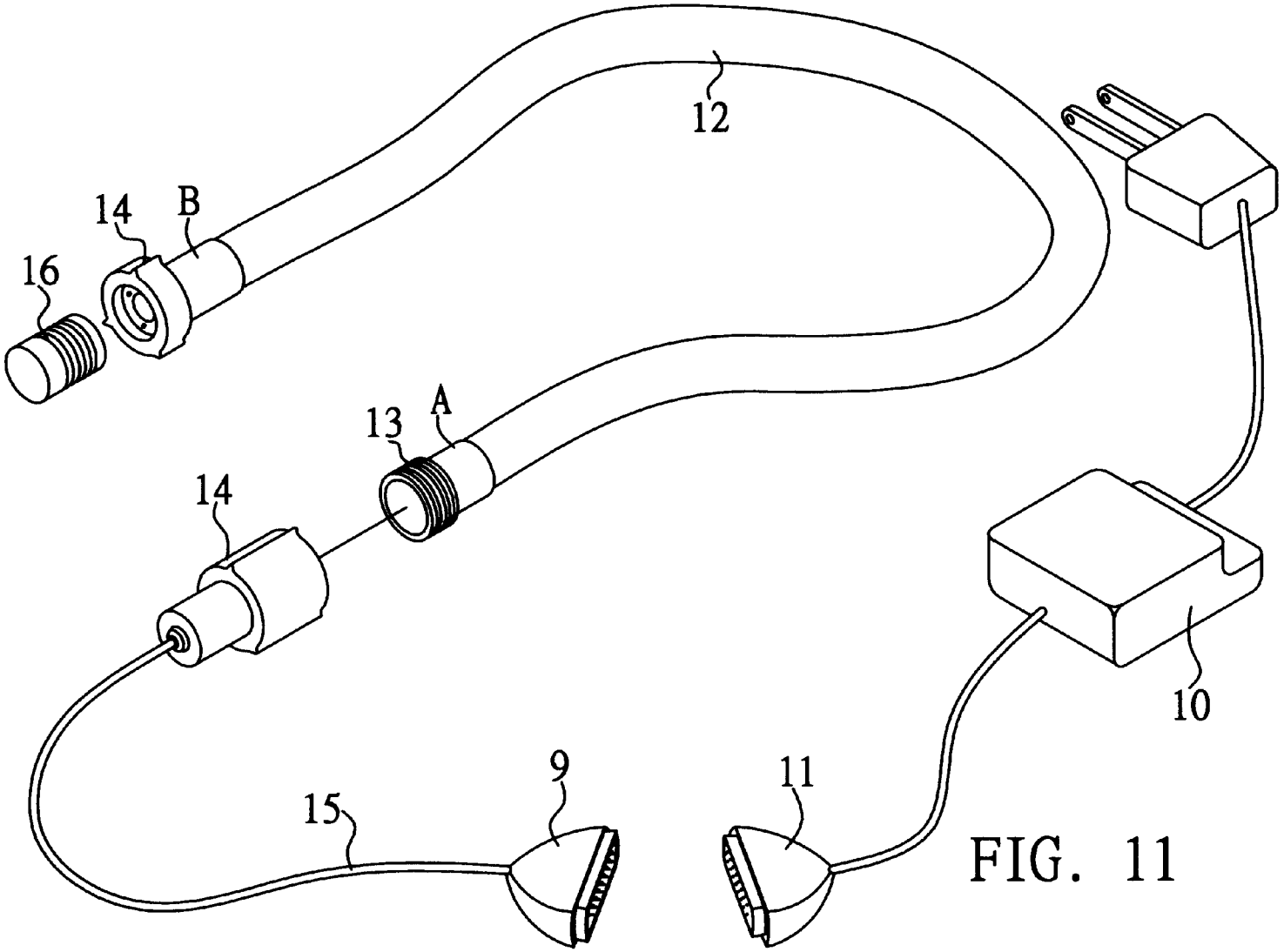
FIG. 11 is a schematic perspective diagram used to show the coupling means used to connect two or more units of light emitting tubes together.

FIG. 11 is a schematic perspective diagram used to show the coupling means used to connect two or more units of light emitting tubes together for the purpose of increasing the overall length of the light emitting part of the ornamental lighting device. As shown, cable 15 of the positive connector 9 is connected to a negative coupler 14 to allow the positive connector 9 to be connectable to the positive coupler 13 at the first end A of the light emitting tube 12. When not in use, a dummy plug 16 can be inserted in the negative coupler 14 for dust protection. When the light emitting part of the ornamental lighting device is to be doubled in length, the dummy plug 16 can be removed to allow the positive coupler (not shown) of another unit of light emitting tube (not shown) to be coupled to the second end B of the light emitting tube 12.

Figure 12A:
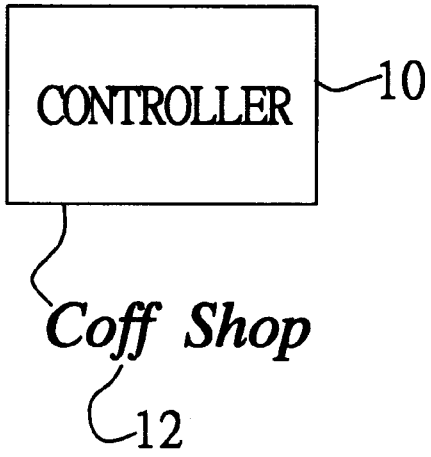
FIGS. 12A–12C are schematic diagrams used to depict three examples of the application of the ornamental lighting device of the invention.
Figure 12C:
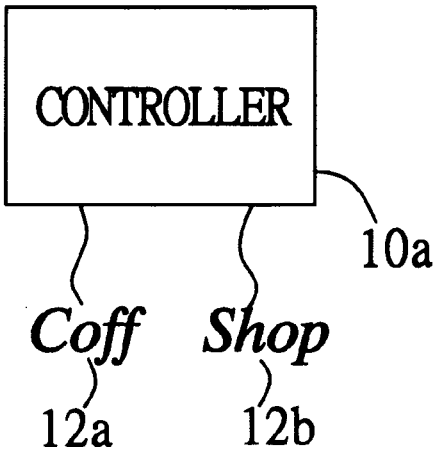
Figure 12B:
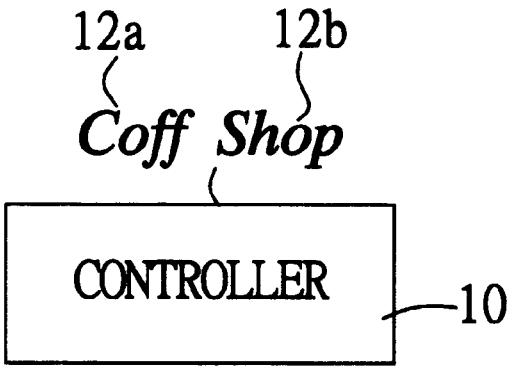

FIGS. 12A–12C are schematic diagrams used to depict three examples of the application of the ornamental lighting device of the invention.

In the example of FIG. 12A, the light emitting tube 12 of the ornamental lighting device is bent into the English letters "Coff Shop". In this case, the controller 10 is set in such a manner as to light up these letters in the sequence C→o→f→f→S→h→o→p. If one light emitting tube 12 is not long enough to portray all these letters, the example of FIG. 12B can be used.

In the example of FIG. 12B, two units of light emitting tubes 12*a,* 12*b* are connected together, with the first light emitting tube 12*a* being used to portray the letters "Coff" and the second light emitting tube 12*b* being used to portray the letters "Shop". The controller 10 is set in such a manner as to light up these letters concurrently in the two sequences C→o→f→f and S→h→o→p.

Alternatively, as shown in FIG. 12C, the two units of light emitting tubes 12*a,* 12*b* shown in FIG. 12B can be instead connected respectively via two separate cables to the controller 10, with the first light emitting tube 12*a* being used to portray the letters "Coff" and the second light emitting tube 12*b* being used to portray the letters "Shop". The controller 10 is set in such a manner as to light up these letters concurrently in the two sequences C→o→f→f and S→h→o→p. In addition, the controller 10 can be set to light up the letters in any desired sequences.

In conclusion, the ornamental lighting device of the invention can light up its lamps alternatively in any predetermined sequences. Moreover, the ornamental lighting device of the invention is easier to manufacture and more reliable to use as compared to the prior art and can radiate lights uniformly from the center of the elongated transparent tube. The invention is therefore more advantageous in manufacture and utilization than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An ornamental lighting device having a light emitting section comprising:

a) an elongated transparent tube having a first end, a second end and a hollow cavity therein; and having a light emitting section;

b) a set of insulated conductive wires including one common wire and a plurality of triggering wires;

c) a plurality of bands connected in parallel, each of said bands having serially-connected lamps, each of said bands of serially-connected lamps having one end electrically connected to said common wire and the other end connected to one of said triggering wires;

d) said plurality of bands of serially-connected lamps being mounted in said hollow cavity of said elongated transparent tube in a staggered arrangement such that a second band of serially-connected lamps starting where a first band of serially-connected lamps ends, the third band of serially-connected lamps starting where said second band of serially-connected lamps ends, and each succeeding band starting where the previous band ends;

e) a controller connected to said insulated conductive wires, which is capable of applying a voltage alternately in a predetermined sequence to said triggering wires so as to light up said light emitting section from each of said bands of serially-connected lamps in said predetermined sequence.

2. The ornamental lighting device in accordance with claim 1, wherein said insulated conductive wires are bundled into a cable.

3. The ornamental lighting device in accordance with claim 1, wherein said common wire is embedded in a surface layer of said elongated transparent tube.

4. The ornamental device in accordance with claim 1, further including a first-type of connector wired to said insulated conductive wires; and a second-type of connector wired to said controller, which can be coupled to said first-type connector so as to electrically connect said insulated conductive wires to said controller.

5. The ornamental lighting device in accordance with claim 1, further including a positive coupler fixed at said first end of said elongated transparent tube; and a negative coupler fixed at said second end of said elongated transparent tube, allowing said light emitting section of said ornamental lighting device to be sectionally increased in length by connecting said negative coupler to said positive coupler of another unit of said elongated transparent tube.

6. The ornamental lighting device in accordance with claim 5, further including a dummy plug for insertion into said negative coupler when said negative coupler is not in use for connection to another unit of said elongated transparent tube.

7. The ornamental lighting device in accordance with claim 1, wherein said elongated transparent tube is formed with a V-shaped opening through the wall thereof to allow said lamp bands to be inserted therethrough to be assembled in said hollow cavity thereof.

* * * * *